US009463129B2

(12) United States Patent
Hallman

(10) Patent No.: US 9,463,129 B2
(45) Date of Patent: Oct. 11, 2016

(54) GROSSING STATION

(75) Inventor: George Hallman, Washington, MI (US)

(73) Assignee: MP ACQUISITION, LLC, Grand Rapids, MI (US)

( * ) Notice: Subject to any disclaimer, the term of this patent is extended or adjusted under 35 U.S.C. 154(b) by 885 days.

(21) Appl. No.: 13/200,636

(22) Filed: Sep. 27, 2011

(65) Prior Publication Data

US 2013/0074261 A1 Mar. 28, 2013

(51) Int. Cl.

| | |
|---|---|
| ***A61G 13/10*** | (2006.01) |
| ***F24F 7/00*** | (2006.01) |
| ***A61G 13/06*** | (2006.01) |
| ***A61G 13/00*** | (2006.01) |

(52) U.S. Cl.

CPC ..... *A61G 13/06* (2013.01); *A61G 13/0027* (2013.01); *A61G 13/102* (2013.01); *A61G 13/107* (2013.01); *A61G 13/108* (2013.01)

(58) Field of Classification Search

CPC ... A61G 13/0027; A61G 13/00; B08B 15/02
USPC ..... 454/49; 5/600
See application file for complete search history.

(56) References Cited

U.S. PATENT DOCUMENTS

| | | | | |
|---|---|---|---|---|
| 2,512,747 | A * | 6/1950 | Lewis | 422/301 |
| 2,702,505 | A * | 2/1955 | Nelson | 454/62 |
| 3,799,534 | A | 3/1974 | Coles | |
| 3,874,754 | A * | 4/1975 | Saunders et al. | 454/56 |
| 4,038,974 | A | 8/1977 | Pielkenrood | |
| 4,402,144 | A * | 9/1983 | Dumke | 34/192 |
| 4,650,171 | A | 3/1987 | Howorth | |
| 4,876,773 | A | 10/1989 | Wade | |
| 4,898,089 | A * | 2/1990 | Roos | 454/49 |
| 4,901,410 | A | 2/1990 | Fischer et al. | |
| 4,980,956 | A | 1/1991 | Fischer et al. | |
| 5,042,456 | A * | 8/1991 | Cote | 454/67 |
| 5,093,969 | A | 3/1992 | McGuire | |
| 5,181,883 | A * | 1/1993 | Hofstra et al. | 454/49 |
| 5,244,433 | A | 9/1993 | Utterback | |
| 5,303,659 | A | 4/1994 | Berlin et al. | |
| 5,621,929 | A | 4/1997 | Smith | |

(Continued)

FOREIGN PATENT DOCUMENTS

| | | | |
|---|---|---|---|
| GB | 2339275 | A * | 1/2000 |
| SU | 1791048 | A1 * | 1/1993 |

OTHER PUBLICATIONS

Mopec MB Series Grossing Stations, Mar. 18, 2010, retrieved from Wayback Machine at https://web.archive.org/web/20100318084612/http://www.mopec.com/literature.php.*

(Continued)

*Primary Examiner* — Alissa Tompkins
*Assistant Examiner* — Phillip E Decker
(74) *Attorney, Agent, or Firm* — Raggio & Dinnin, P.C.

(57) ABSTRACT

A grossing station for use with performing autopsy, necropsy or pathology procedures comprises a table and an overhead hood connected to a top surface of the table. The grossing station further comprises a blower and ventilation system arranged in the table to move air across the table from a front to rear direction. The grossing station also comprises a trough arranged in an upper surface of the table, wherein the trough receives a plurality of interchangeable grid plates or sinks therein. The grossing station also comprises a first and second panel arranged at the side of the hood in order to create a fume hood for use by the user of the grossing station.

18 Claims, 10 Drawing Sheets

(56) References Cited

U.S. PATENT DOCUMENTS

| | | | | |
|---|---|---|---|---|
| 5,904,162 | A * | 5/1999 | Ferguson et al. | 134/25.2 |
| 6,050,660 | A * | 4/2000 | Gurley | 312/249.1 |
| 6,279,510 | B1 | 8/2001 | Batterton | |
| 6,694,892 | B2 | 2/2004 | Lin et al. | |
| 7,428,882 | B2 | 9/2008 | Keil | |
| 7,468,161 | B2 * | 12/2008 | Reinhardt et al. | 422/63 |
| 2006/0154590 | A1 * | 7/2006 | Kanaya | 454/56 |
| 2006/0180057 | A1 * | 8/2006 | Hallman | 108/147 |
| 2008/0202491 | A1 * | 8/2008 | Eberhard | 454/65 |
| 2012/0037049 | A1 * | 2/2012 | Martin et al. | 108/50.11 |
| 2012/0260418 | A1 * | 10/2012 | Rundberg et al. | 4/623 |

OTHER PUBLICATIONS

Mopec ME Series Dual-Draft Grossing Workstations, Mar. 18, 2010, retrieved from Wayback Machine at https://web.archive.org/web/20100318084612/http://www.mopec.com/literature.php.*

Mopec Literature web page, Mar. 18, 2010, https://web.archive.org/web/20100318084612/http://www.mopec.com/literature.php.*

* cited by examiner

GROSSING STATION

BACKGROUND OF THE INVENTION

1. Field of the Invention

The present invention generally relates to an autopsy table and more particularly relates to a grossing station having interchangeable grid plates and a blower and ventilation system that moves air across the entire table in a front to rear direction.

2. Description of Related Art

Autopsy tables, grossing tables, necropsy tables and trimming tables are all well known in the art. These tables are designed to accommodate a body or other part of a body while a post mortem examination is carried out or pathology is conducted on an organ or other body part. Many of these autopsy tables and/or grossing stations in the prior art were made of simple ceramic slabs with no exhaust systems. Recently these prior art autopsy tables have been made of a stainless steel having a discontinuous or perforated surface. These tables may have ventilation systems to reduce the odor associated with chemicals and natural fluids and components that are associated with an autopsy or pathology procedure. The use of ceramic slabs or stainless steel create an easy to clean surface that generally are non porous and easy to disinfect after each autopsy or pathology procedure is conducted.

Many of these prior art autopsy stations include an assortment of components used in conjunction therewith. For instance, an autopsy station may include a plurality of faucets that are used for transferring liquids, gas, or vapors to the autopsy station. Such liquids can be formaldehyde, other chemicals, water, or any other type of chemical or substance needed during an autopsy or pathology procedure. The autopsy tables of the prior art generally also include an air system that includes an air intake and air exhaust vents that may also include filters and like to constantly clean the air and reduce odors from the autopsy table and surrounding environment. Furthermore, sinks are generally located within an autopsy table. Grating surfaces may also be located on the autopsy table for allowing fluids to be removed and collected during autopsy of the human or animal body. Furthermore, autopsy tables may also be arranged such that a gurney or cart may be used in conjunction with the autopsy table or grossing station for delivering the body or for holding the body during the autopsy procedure. The gurney or cart is capable of being secured in position against a predetermined surface of an autopsy table and may also be inclined to any required angle necessary for the user performing the autopsy.

Prior art autopsy tables have generally been used in fixed positions in a post mortem room, hospital, laboratory or the like. Furthermore, these tables generally are fixed in a position that is convenient for a predetermined average size human to conduct the work of the autopsy or pathology procedures in a comfortable, non-stress inducing manner in a standing or seated position.

One possible problem associated with prior art autopsy, necropsy, or grossing stations or tables is that they are fixed at a single height and are not adjustable to provide an ergonomically friendly use for people of various heights. Another potential problem with prior art autopsy tables may be that many of them do not have a blower and ventilation system that allows specific autopsy or necropsy procedures that have to be performed in a fume hood to occur if necessary. Furthermore, another problem in the prior art maybe an autopsy table that uses formalin or formaldehyde in an autopsy or necropsy procedure will not have an integrated system for storing and using the formalin, formaldehyde or other autopsy liquids during use thereof. Furthermore, many of these prior art autopsy tables are not capable of being adjusted to various heights. Also, many prior art autopsy tables include a predetermined stainless steel top with a perforated section arranged thereon without any ability to interchange or use different configurations for the autopsy table.

Therefore, there is a need in the art for an improved grossing station that is capable of being mounted either to a wall or directly on a floor that will have a mechanism that will elevate the work surface to a user's selected predetermined height. There also is a need in the art for an improved blower and ventilation system for use on a grossing station that may allow for air to be passed directly across the entire table including the sink of the grossing station in a forward to rearward direction of the table. There also is a need in the art for a grossing station that has interchangeable grid plates that may allow for any known configuration of a grossing station to be configured into a grossing station by removal and replacement of grid plates into any known pattern including right handed sinks, left handed sinks, two sinks, or any other known arrangement of perforated and solid plates arranged therein. There also is a need in the art for a grossing station that has an integrated formalin or formaldehyde distribution and storage system. There also is a need in the art for a grossing station that has slidable slide glass panels that allow for the grossing station to also operate as a fume hood to remove all fumes being emitted during the autopsy or necropsy procedure.

SUMMARY OF THE INVENTION

One object of the present invention may be to provide a novel and unique grossing station.

Another object of the present invention may be to provide a grossing station that has a blower and ventilation system that moves air across the entire table including the sink of the grossing station.

Still another object of the present invention may be to provide a grossing station that includes a plurality of blowers arranged in a front edge of the grossing station and at least one blower arranged in a hood or near a rear edge of the grossing station to help move air across the table and sink of the grossing station.

Still another object of the present invention may be to provide a grossing station that includes interchangeable grid plates that will fit into a trough on the grossing station.

Still another object of the present invention may be to provide interchangeable grid plates in the form of a sink, a perforated plate or a solid plate such that both a left handed or right handed grossing station may be made depending on the user of the grossing station.

Still another object of the present invention may be to provide a grossing station that has an integrated liquid system for holding formalin or any other liquid used during autopsy, necropsy or any pathology procedure.

Still another object of the present invention may be to provide for a grossing station that maybe adjusted to various heights in order to accommodate different sized technicians using the grossing station.

Yet another object of the present invention may be to provide a grossing station that has slidable glass panels arranged on each side thereof, which allows for the grossing station to operate as a fume hood when the sliding glass panels are extended to their fully extended position.

According to the present invention, the foregoing and other objects and advantages are obtained by a novel design for a grossing station for use in an autopsy, necropsy or pathology procedure. The grossing station comprises a table and an overhead hood connected to the table. The grossing station also comprises a blower and ventilation system arranged on the table which moves air across the table from a front to a back direction. The grossing station also comprises a trough arranged in an upper surface of the table. The grossing station may also comprises a plurality of interchangeable grid plates arranged in the trough to allow for an either left handed or right handed grossing station depending on the user of the grossing station.

One advantage of the present invention may be that it provides a novel and unique grossing station.

Another advantage of the present invention may be that it provides for a grossing station that has a blower and ventilation system which moves air across the entire surface of the table including any sinks in a forward to rear direction.

Still another advantage of the present invention may be to provide a grossing station that includes a plurality of blowers arranged at a front edge or lip of the grossing station and one larger blower arranged at a rear portion of the grossing station or in a hood.

Still another advantage of the present invention may be that it provides a grossing station that has interchangeable grid plates that fit into a trough of the grossing station.

Yet another advantage of the present invention may be that it provides for a grossing station that includes interchangeable grid plates in the form of a sink, solid plates, or perforated plate, etc.

Still another advantage of the present invention may be that it provides for a grossing station that has an integrated formalin system that allows for storage and removal of the formalin used in the autopsy or necropsy procedures.

Still another advantage of the present invention may that it provides for a grossing station that has a waste compartment secured to the grossing table at any of a number of predetermined positions.

Still another advantage of the present invention may be that it provides for a grossing station that has glass panels arranged on each side thereof which are slidable and allow for the grossing station to be used as a fume hood.

Still another advantage of the present invention may be that it provides a grossing station that includes a slideable shelf arranged in a base of the grossing station.

Other objects, features and advantages of the present invention will become apparent from the subsequent description, and appended claims taken in conjunction with the accompany drawings.

DESCRIPTION OF THE EMBODIMENT(S)

Figure 1:
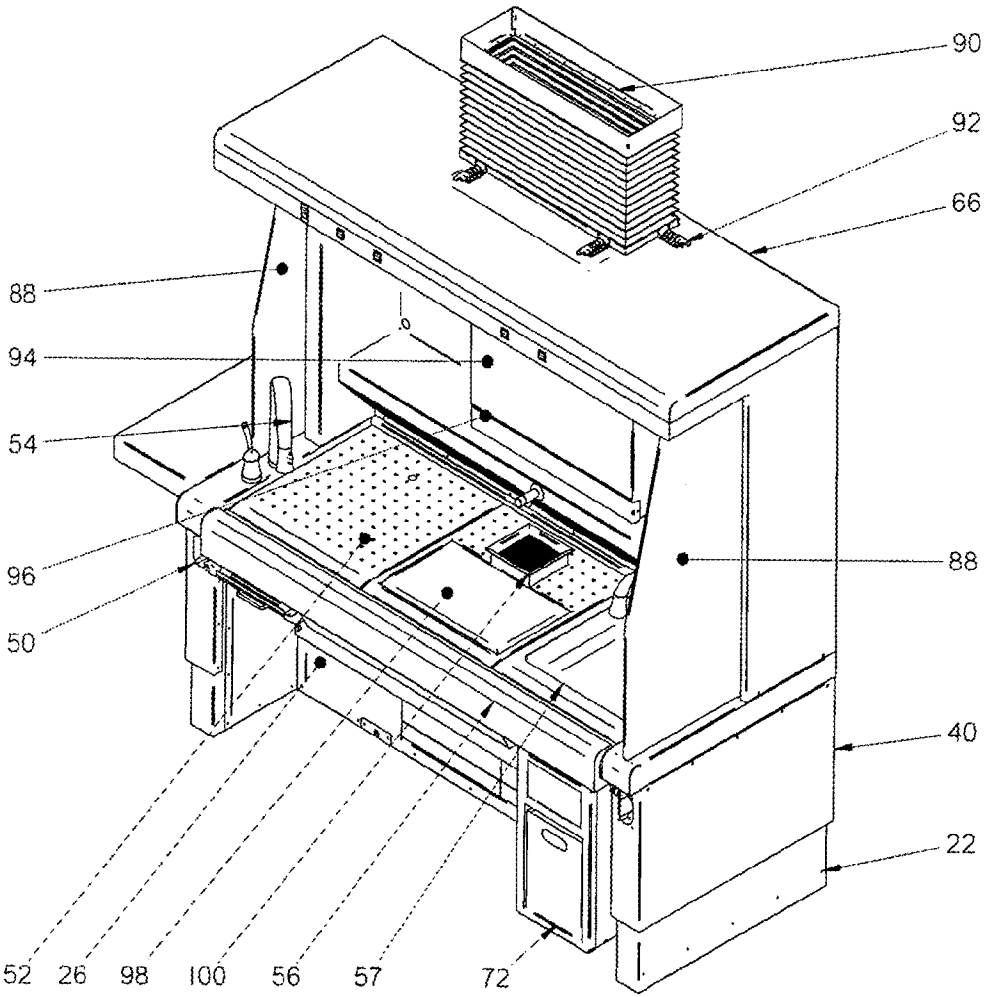
FIG. 1 shows a perspective view of a grossing station according to the present invention.

Referring to the drawings, a grossing station 20 that is capable of being adjusted to various heights as shown according to the present invention. It should be noted that the grossing station 20 may be used on any known autopsy, necropsy, trimming, pathology, or any other procedure performed on tissues or the like all of which are for use in hospitals, morgues, funeral homes, university laboratories, other laboratories and any other structure that can be used for examining human or animal bodies or human and animal body parts.

Figure 3:
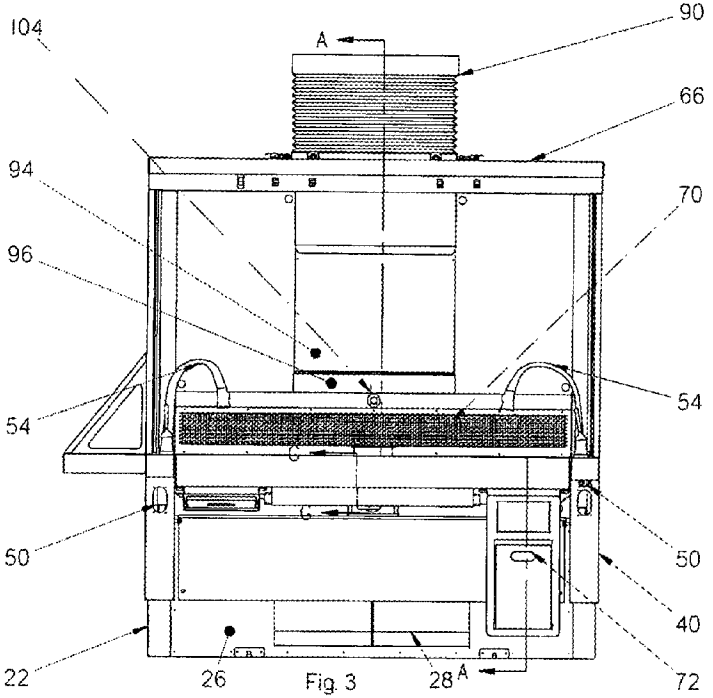
FIG. 3 shows a front view of a grossing station according to the present invention.
Figure 5:
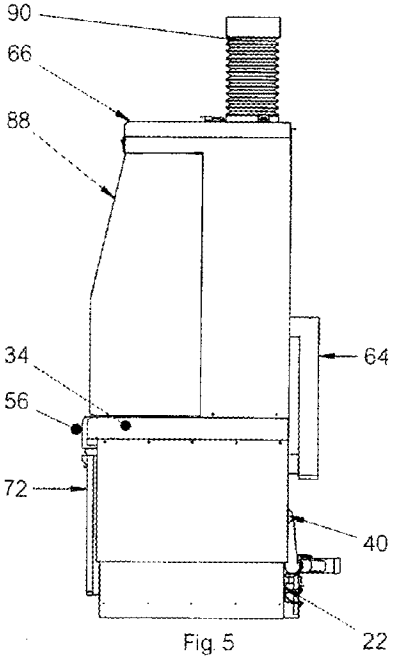
FIG. 5 shows a side view of a grossing station according to the present invention.

The grossing station 20 of the present invention includes a base 22, which generally is arranged on a floor or other surface in a lab or room in which the grossing station 20 may be used. It should be noted that it is also contemplated to attach the grossing station base 22 to a wall and elevate it off of the floor or to place it on a frame above the floor. The base 22 generally includes a first and second leg 24 and a cross member 26 arranged therebetween. The base 22 may have any known predetermined height and width. Each of the legs 24 generally may have a square or rectangular shape when viewed from the side. The base 22 may have an appropriate pad arranged at a bottom surface of the legs 24 which engages with the floor or a surface of the lab in which the grossing station 22 is arranged. The base 22 may include an opening in the cross member 26 thereof which may have a door 28 arranged in the opening. The door 28 in one contemplated embodiment as shown in the Figures is a sliding door 28 with two pieces. The sliding door 28 in one contemplated embodiment may have glass panels arranged in the door 28 in order to see the contents arranged within the sliding door 28 of the base 22. It should be noted that any other type of door, such as a swing door, panel door, folding door or the like may be used. The first and second portion of the sliding door 28 may slide behind the front panel of the cross member 26, such that the entire opening of the cross member 26 may be exposed. Arranged within the opening of the cross member 26 and secured to the base 22 of the grossing station 20 is a slidable shelf 30. The slidable shelf 30 may slide out through the orifice or opening of the cross member 26 of the base 22 toward the front of the grossing station 20. The slidable shelf 30 may be made of any known material and may have any known dimensions. In one contemplated embodiment the slidable shelf 30 may be affixed via rollers on each side thereof to a channel secured to the base 22 of the grossing station 20. The rollers or hinges may be secured to a bottom lower outer edge of the slidable shelf 30 on each side thereof. However, it is also contemplated to have roller or hinge arranged at the top end or back end of the shelf or at a mid point of the sliding shelf 30 depending on the design requirements of the grossing station 20. The slidable shelf 30 generally may have a rectangular bottom surface that may or may not have a perforated panel arranged thereon. A lip 32 may be formed at the front edge of the sliding shelf 30 or along the entire outer periphery of the sliding shelf 36. It should be noted that the sliding shelf 30 may have any other known shape other than rectangular depending on the design requirements of the grossing station 20. In one contemplated embodiment the sliding shelf 30 may also have a full back wall extending from the rear edge of the shelf 30 and either full side walls or partial walls as shown in the Figures. It should be known that a small edge, such as the front edge shown in FIG. 3, may be arranged around the entire shelf or the shelf 30 may have a closable door with high walls completely surrounding the bottom surface of the slidable shelf 30. It should be noted that any known sliding methodology other than that described above may be used to create the sliding effect between the slidable shelf 30 and the base 22 of the grossing station 20. In one contemplated embodiment the sliding shelf 30 may be used to hold and store formalin or other chemicals used during autopsy, necropsy or pathology procedures. This may allow for the formaldehyde or formalin to be passed through associated tubing from the storage container up to the surface of the grossing station table and then return to a holding container which is located outside of the sliding shelf or on the sliding shelf 30 itself. A plurality of connections may end in faucets, spickets, spray guns, or the like on the grossing station work surface to allow for the autopsy procedure being conducted to access the necessary chemicals for preparing, storing and examining the tissues being examined. It should be noted that the base 22 is generally made of a metal material, however any other ceramic, composite, natural material, plastic or the like may be used for the base 22 and the slidable shelf 30 arranged therein. Furthermore, the panels used on the door 28 of the base 22 generally have a glass material arranged therein to allow for viewing of the contents of the slidable shelf 30. However, any other known plastic, ceramic, composite, natural material, metal or the like may also be used for the doors 28 arranged on the base 22 in front of the slidable shelf 30.

The grossing station 20 also includes a table 34 or work surface area arranged over a top portion of the base 22. The table 34 may have a generally rectangular and flat work surface arranged on the top end thereof and a first and second leg 36 arranged on the sides thereof. The first and second legs 36 are arranged over the first and second legs 24 of the base 22. A lifting mechanism 38 is arranged between the base 22 and the table 34 of the grossing station 20. This may allow for the table 34 to be adjusted to any number of predetermined heights to accommodate different size users conducting the pathology procedures on the grossing station 20. Generally, the legs 36 of the table 34 may have a rectangular shape when viewed from the side. However, any other shaped leg 36 may be used for the legs of the table 34. The table 34 may also have a cross member 40 arranged between the first and second legs 36 of the table 34 and arranged over and may slide over the cross member 26 of the base 22. It should be noted that any type of lifting mechanism 38 may be used on the grossing station 20 of the present invention, such as but not limited to linear actuator, scissor actuator, screw actuator or any other lifting device, electronic, fluid driven, gas driven, air driven, electrical or mechanical driven, may be used to move the table 34 with relation to the base 22 to adjust the grossing station work surface to a predetermined height. The table 34 also includes a trough 42 arranged in a top surface thereof. The trough 42 generally has a rectangular shape in view from above and may have a bottom surface arranged at a predetermined angle that tilts from forward to backward or rearward with relation to the table 40 when viewed from the side. This angle may help any liquids that pass through the work surface or sink of the table 40 to move toward a drain 44 that is connected to a plumbing system or other storage device via any known tubing. The trough 42 also may include a pole or rod 46 that extends across the entire length thereof. The trough 42 generally may be arranged a predetermined distance from a front edge of the table 40. The table 40 may also include an orifice, rod or vent 48 arranged through a mid point or any other surface of the trough 42. The grossing station 20 also may include a switch 50 arranged on a front surface of one of the legs on the grossing station table 40 that may allow for the upward and downward movement of the work surface of the table 40 with relation to the base 22 and floor or surface on which the grossing station 20 is arranged. It should be noted that the associated electronics are in electrical communication with the switch 50 and the lifting mechanism 38 and to the power grid into which the grossing station 20 is connected. Other switches also may be arranged on the table 40 at a predetermined position or any other surface of the grossing station 20 to operate the blower and ventilation system, lights, computers, etc., for the grossing station 20.

The table 40 of the grossing station 20 includes a plurality of removable and interchangeable grid plates 52 which may be arranged and fit securely into the trough 42 of the table 40. The grid plates 52 generally are square, however any other shape grid plate 52 may be used depending on the design of the grossing station table 40. The grid plates 52 may be of any known design, but generally include at least a solid plate design, a perforated plate design, and a sink 57. This may allow the user of the grossing station 20 to customize the work surface for the grossing station 20 per their requirements. It is contemplated to use the grid plates 52 in any combination of perforated grid plates, solid plates and sinks, a combination of sinks and perforated plates, a combination of sinks and solid plates, a combination of all sinks, a combination of all perforated plates and one sink 57, etc. Any known configuration may be used with the interchangeable grid plates 52. Generally, the interchangeable grid plates 52 may have a rounded front edge to help create an ergonomic edge for use by the user of the grossing station 20. The grid plates 52 may interact with a first and second shoulder arranged near a top surface of the grossing station table 40 at the trough edges. The sink 57 which may be used as one of the grid plates may have a drain hole that interacts with the trough 42 and a drain 48 that is connected to the trough 42 which then drains to the sewage system or other storage area of the building into which the grossing station 20 is arranged. These connections are made by any known piping used in the plumbing industry. It should be noted that the grossing station 20 may be set up in either a right handed sink setup or a left handed sink setup depending on the dominant hand of the user of the grossing station 20. Generally, connected to the top surface on either one or both sides of the table 40 may be a water faucet 54 which may allow for water to be used on either side of the grossing station 20 and to be drained into either a left handed or right handed sink. It should be noted that in one contemplated embodiment a faucet 54 is arranged on both sides of the grossing station top surface of the table 40 or it may be just arranged on one side depending on the design requirements and configuration of the grossing station 20. It is also contemplated to use touch or no touch faucets along with normal faucets that include a handle or knob to start and stop water flow. The faucets 54 are connected via any known plumbing piping such as plastic, copper, or any other known plumbing piping to the water system of the building into which the grossing station 20 is arranged or to a separate water system that is separate from the building system. It should be noted that the interchangeable grid plates 52 may be arranged in any known pattern and may have any known shape other than the rectangular or square shape as shown in the Figures. The perforated plates 52 may also have reinforced edges that interact with shoulders on the trough 42 of the table 40 to secure the grid plates 52 within the trough 42 to ensure a sturdy non slide work surface.

Figure 12:
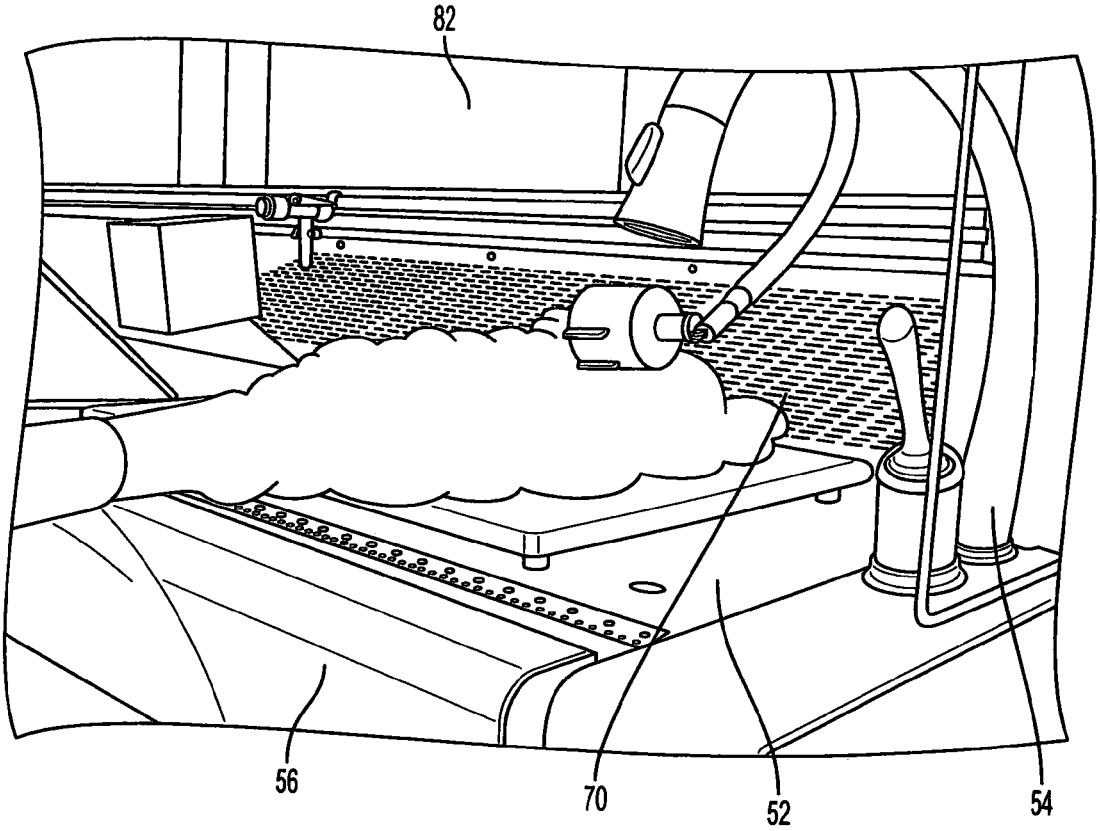
FIG. 12 shows a blower and a ventilation system of the grossing station according to the present invention and operation.

The table 40 also may include a blower and ventilation system which may move air across the entire table 40 including any sinks 57 arranged within the top surface of the table 40 in a forward to rear direction. The blower and ventilation system includes a ventilation duct 56 which is arranged and secured over a front edge of the top surface of the table 40. Any known fastening technique, such as welding, fasteners, or the like may be used to secure the ventilation duct 56 to the front edge of the table 40. The ventilation duct 56 generally has a C-shaped when viewed in cross section and may move air from at least one blower 58 arranged in an edge at the top edge of the table 40. The fan or blower 58 may move air surrounding the grossing station 20 into a channel 60 through the blower 58 and then through a generally C-shaped channel 62 of the vent duct 56. It should be noted that in one contemplated embodiment nine fans 58 may be arranged at predetermined equidistant or non equidistant locations along the front edge of the grossing station 20. In one embodiment the nine fans 58 may have approximately a six cubic foot per minute output and move air from the vent duct 56 directly onto the work surface, i.e., grid plates 52, of the table 40 of the grossing station 20. The angle at which the air exits the vent duct 56 exit orifice is defined by an inner surface and may be set at any angle. Any known fastening technique may be used to secure the nine fans or blowers 58 to the inner front edge of the table 40. It should be noted that any other number of fans may be arranged within the front edge of the table 20 of the grossing station 20 from one to thirty depending on the size and environment in which the grossing station 20 may be used. This may allow for use of the nine blowers 58 in the front edge to send air through the vent duct 56 to the top surface of the table 40 to allow for a front to rear evacuation of odors and air on the grossing station 20. The blowers 58 may also be arranged in and secured to the vent duct 56. The blower ventilation system also includes in one contemplated embodiment one blower 64 arranged at or near a rear edge of the work surface of the table 40 or in the hood 66 secured to the top surface of the table 40. This blower 64 generally is a large blower which may create a suction, flow or vacuum and evacuate the air being sent over the top of the table 40 from the front edge blowers 58 into a grate 70 and remove the fumes into either a filter, other storage area or vent it directly to the outer atmosphere surrounding the building. The necessary duct work is either secured to a rear edge of a table 40 of the grossing station or to the hood 66 of the grossing station and then by the necessary ducting and piping to either a filter system, a storage area, or the outer atmosphere. It should be noted that all of these components described generally are made of a stainless steel material, however any other metal, ceramic, plastic, composite or natural material may also be used to make these components. FIG. 12 shows an example of the venting and blower system in operation across the top surface of the grossing station table 40. As shown, the air blown out from the ventilation duct 56 may move any fumes or gas, shown in the form of smoke in FIG. 12, to the rear grid plate area 70 arranged at the rear edge of the table 40 and move the fumes and odors from the table top surface directly to a storage area, the outer atmosphere or a filter mechanism. The air flow is constant and removes all odors and fumes from all portions of the table top surface including the sinks.

Figure 6:
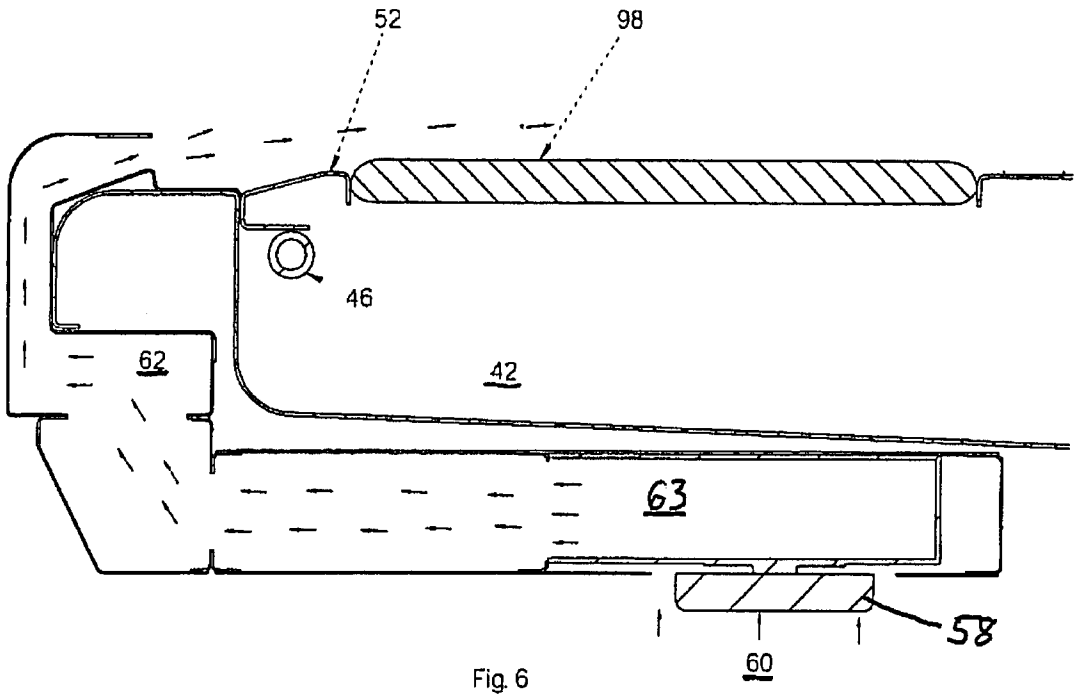
FIG. 6 shows a cross sectional view of a grossing station table according to the present invention.
Figure 7:
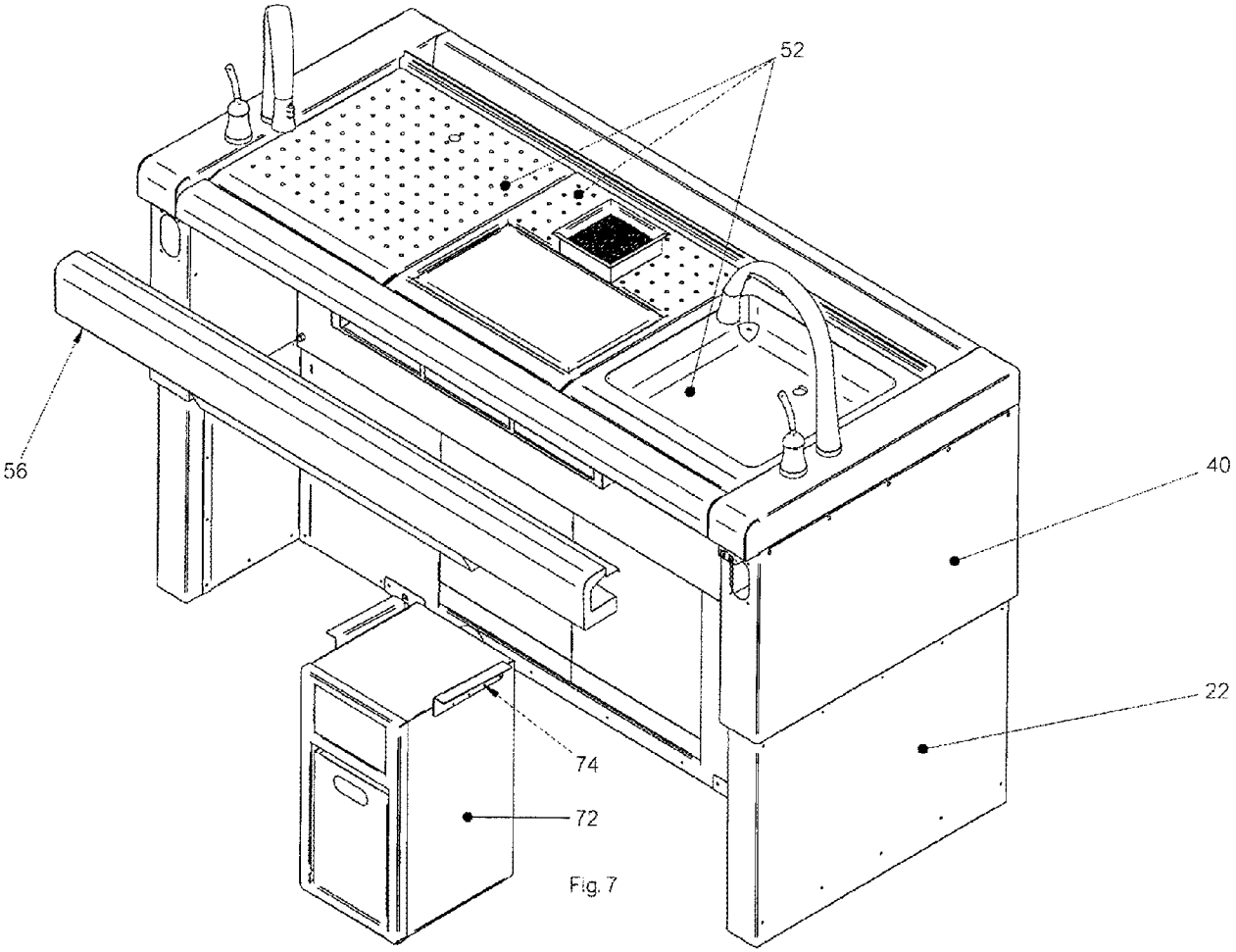
FIG. 7 shows a partial exploded view of a grossing station table according to the present invention.
Figure 8:
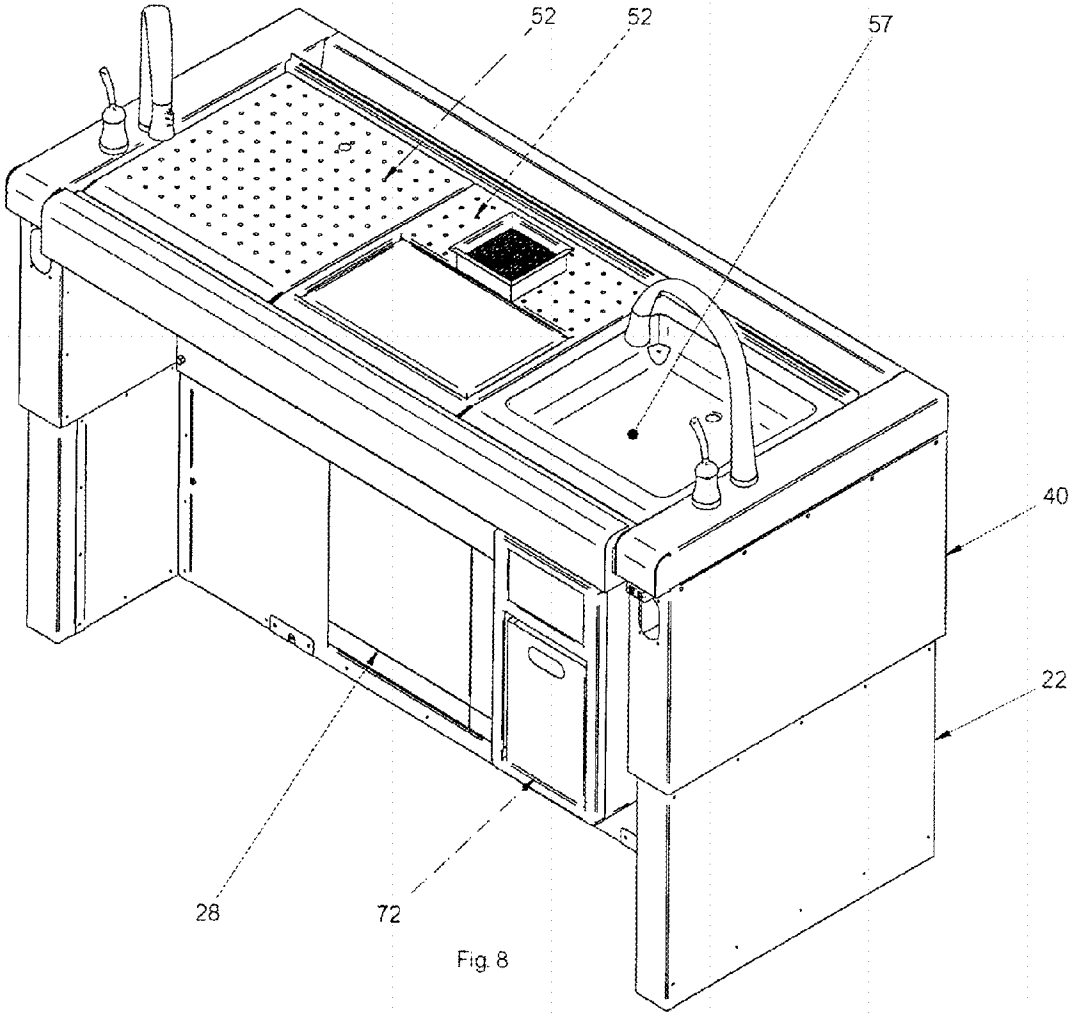
FIG. 8 shows a view of a grossing station table in its fully extended height according to the present invention.
Figure 9:
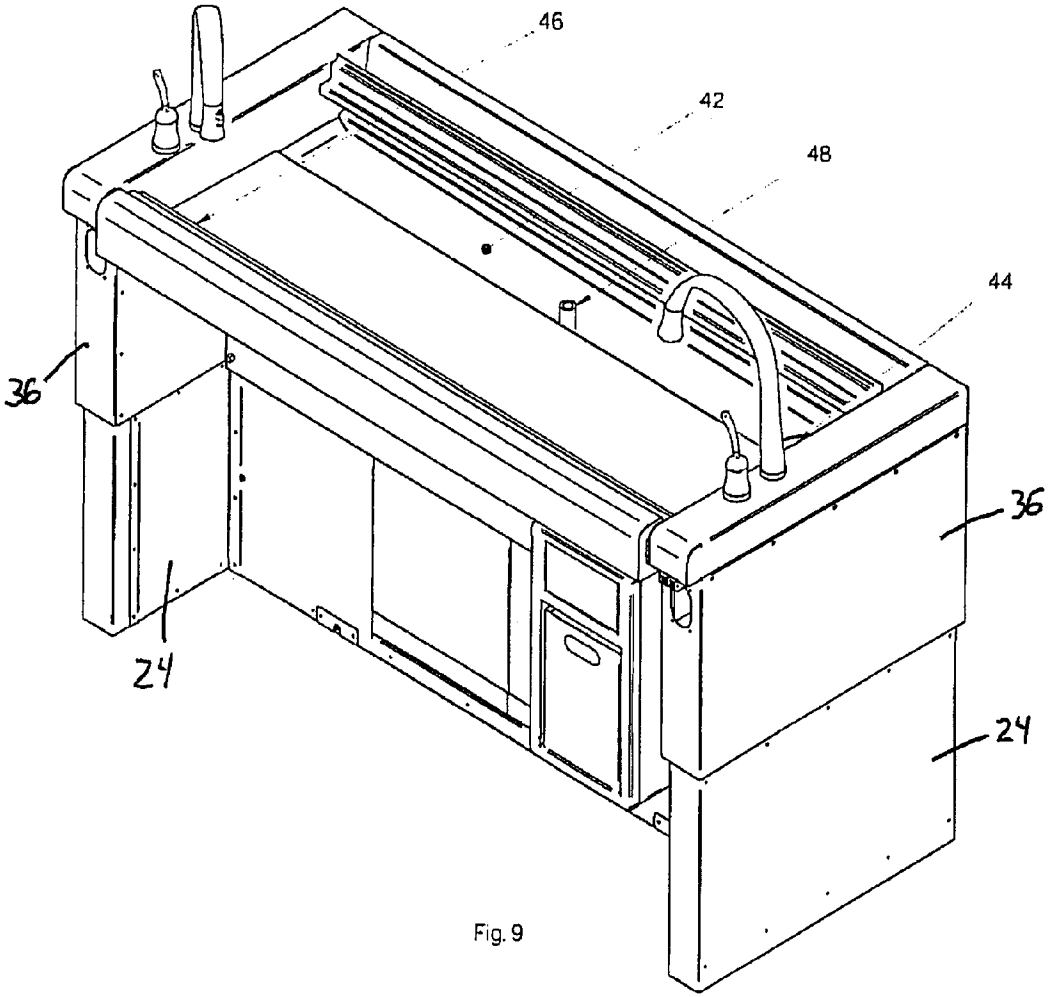
FIG. 9 shows a view of a grossing station table according to the present invention.
Figure 10:
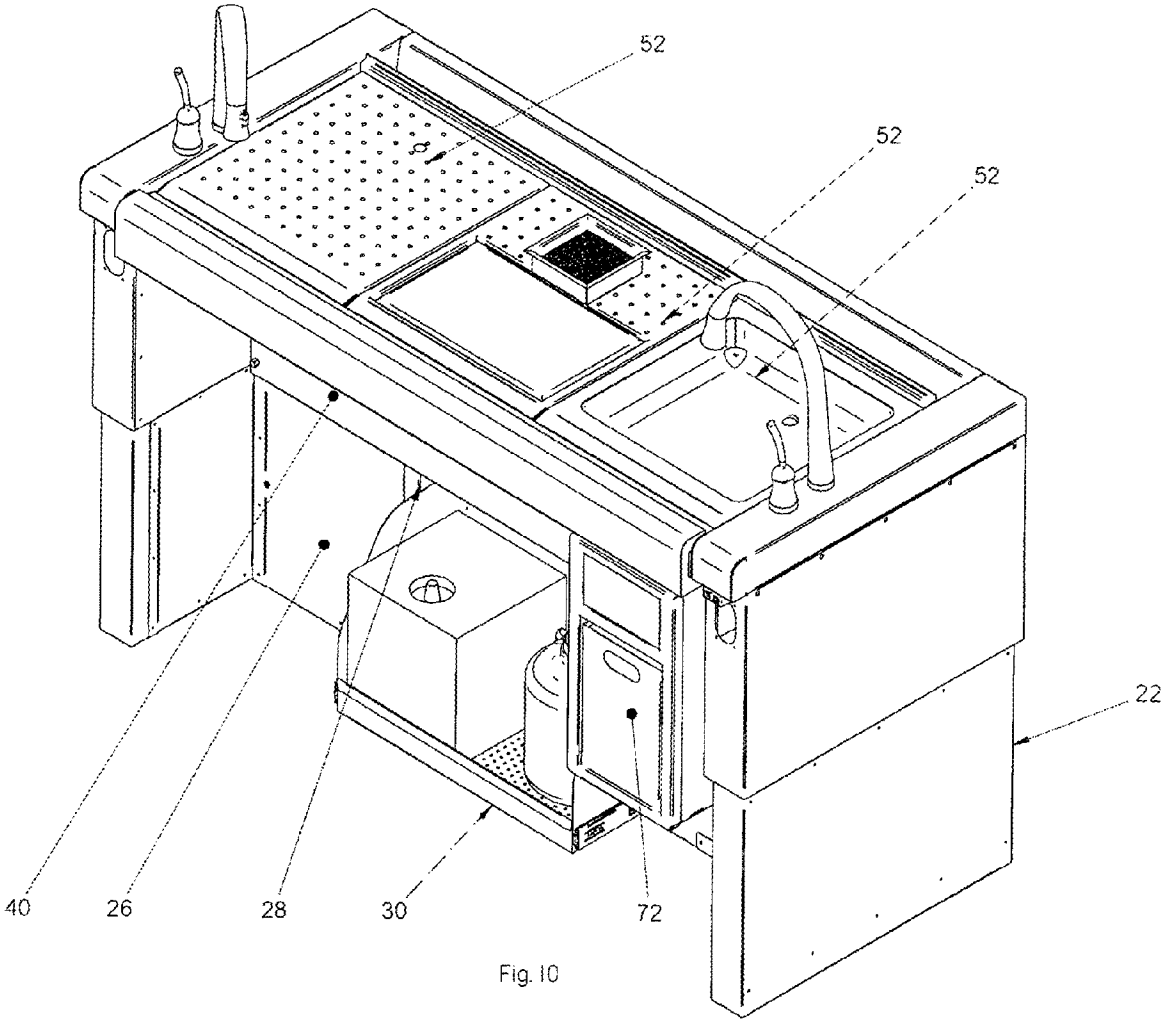
FIG. 10 shows a sliding shelf of a grossing station table according to the present invention.
Figure 11:
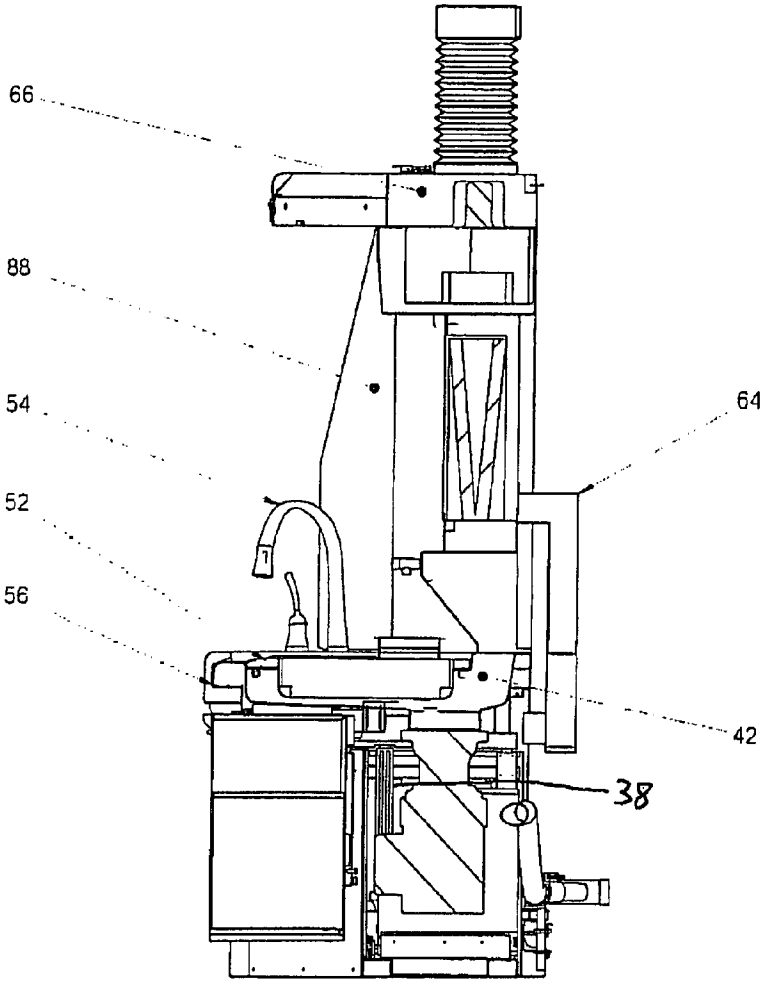
FIG. 11 shows a cross section of a grossing station according to the present invention.

Another contemplated embodiment of the grossing station 20 may have a ventilation duct 56 which generally includes a C-shaped channel 62 as described above but also have an elongate generally straight channel 63 connected to the C-shaped channel 62 and arranged back towards a mid point of the table 40 of the grossing station 20. The intake for this extension 63 may generally be arranged on a bottom surface of the table 40 of the grossing station 20 and the plurality of fans 58 may be located at this mid point within the blower and ventilation system as shown in FIG. 6. It should be noted that this alternate embodiment design for the ventilation duct system generally operates in the same manner as the previously described ventilation duct system.

The table 40 also may include a waste compartment member 72 arranged either on a right or left side on an underside of the table 40. The waste compartment member 72 generally may be used to hold medical waste resulting from the autopsy, necropsy, or pathology procedure being conducted. Any known fastening techniques such as L-brackets 74 as shown may be used to secure the waste compartment 72 in either a right hand or left hand position with relation to the table 40 on an underside surface of the table 40. The waste compartment 72 then may be capable of storing medical waste or having it removed via a door in either the front or side surface of the waste compartment 72. It should be noted that arranged in the surface of the cross member 26 may be a waste compartment vent orifice that may allow for venting of any odors from the waste compartment 72 into a storage area, a filter or the outer atmosphere. A cover plate may cover the vent orifice on the side in which the waste compartment member 72 is not arranged.

Figure 2:
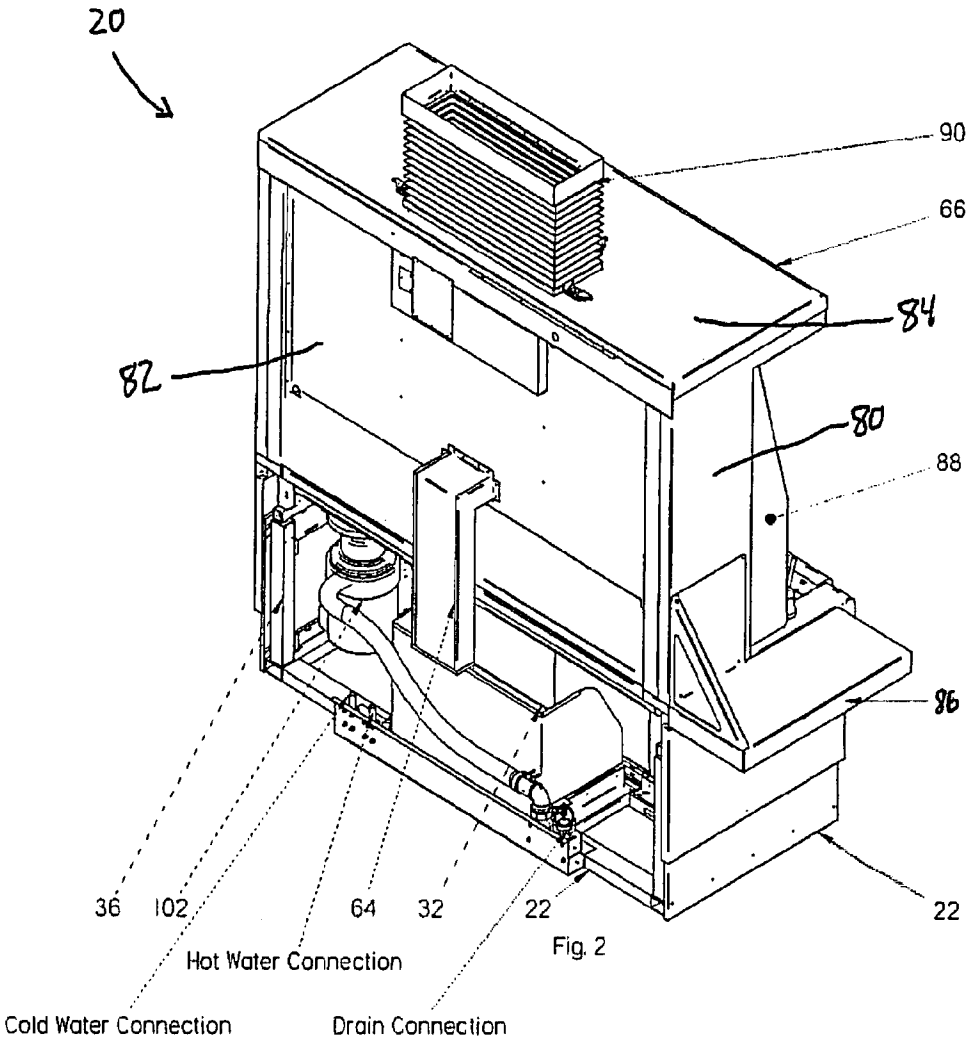
FIG. 2 shows a perspective view of a grossing station from the back according to the present invention.
Figure 4:
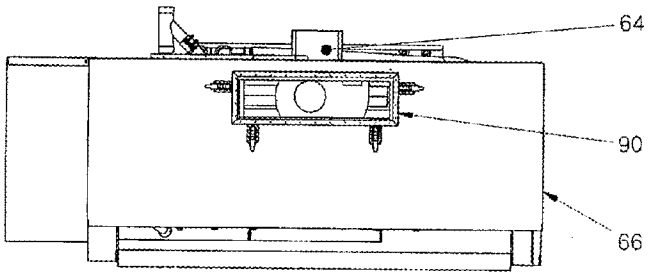
FIG. 4 shows a top view of a grossing station according to the present invention.

The grossing station 20 also may include a hood 66 that is secured to a top surface of the table 40 of the grossing station 20. The hood 66 generally may have two side walls and/or partial sidewalls 80, a rear wall 82 and a top member 84. The top member 84 when viewed from above generally has a rectangular shape. It should be noted that any necessary lighting and associated electronics to control the lighting may be arranged on surfaces of the hood 66 or on the walls of the hood 66. The rear wall 82 of the hood 66 also may have a plurality of shelves arranged thereon for holding supplies, tools, computer equipment, etc., or the like necessary for the pathology procedure being performed on the grossing station 20. It is also contemplated to have a hanging bracket 86 to connect a computer and computer monitor arranged either at a left, right or center portion of the hood generally extending from an inner surface of the hood 66. It is also contemplated to have the computer station arranged on a sliding track that extends the entire length of the hood 66 and allows for the user to move the computer station along the entire length to different positions with relation to the grossing station 20. The hood 66 is generally made of a stainless steel material as are all of the other parts, but may be made of any other metal, plastic, ceramic, composite, or natural material depending on the design requirements and the environment in which the grossing station 20 will be used. The grossing station hood 66 also may include a first and second glass panel 88 arranged at each side thereof. The glass panels 88 may be slidable with relation to the sides of the hood 66. The glass panels 88 may be able to slide into a fully open position that generally aligns with or near the front edge of the table 40 of the grossing station 20. The sliding glass panels 88 also may be recessed back into the side walls 80 of the hood 66 for storage when not needed. In one contemplated embodiment the sliding panels 88 may be made of a glass material, however any other ceramic, composite, natural material, plastic, metal or the like may be used for the sliding panels 88. In one contemplated embodiment the sliding panels 88 may have a generally rectangular shape with an angled surface at one corner thereof as shown in FIGS. 1 and 2. By extending the glass panels 88 into the fully open position, which is at or near the front edge of the top surface of the table 40 of the grossing station 20, it may create a fume hood which may be certified to remove all fumes during the autopsy, necropsy or pathology procedure thus meeting more stringent standards required in some laboratories and hospital environments. However, the panels 88 may also be recessed into a stored position during other autopsy, necropsy or pathology procedures depending on the part being examined during the procedure and the possibility of noxious fumes, gasses or the like being present that would require the use for a fully extended fume hood setup. Any known sliding mechanism or hinge may be used to slide and control movement of the sliding panels 88 into and out of the side walls of the hood 66. It should be noted that any known roller, hinge, or the like may be used to move the glass panels 88 with relation to the side walls of the hood 66. The grossing station 20 also may include a duct 90 extending from a top surface of the hood 66. The duct 90 is generally made of a flexible material and may be arranged between a top surface of the hood 66 to a surface on a wall or ceiling of the room in which the grossing station 20 is arranged. The flexible duct 90 may be made of any known material, including but not limited to, metal, plastic, ceramic, or natural material, etc. The duct 90 is secured to the top surface of the hood 66 of the grossing station 20 by at least one clamp 92. In one contemplated embodiment a plurality of release type clamps 92 may be used to secure the duct 90 to the top surface of the hood 66. It should further be noted that the duct 90 may also be arranged on a back surface of the hood 66. The grossing station 20 also may include a filter system arranged on a surface of the hood 66. The filter system may include a filter door 94 and a prefilter door 96, into which a filter made of any known material is arranged therein. A prefilter, which generally is made of any known absorbent material is arranged adjacent to the filter within the filter system compartment. The filter used in the grossing station 20 according to the present invention may be of any known size and shape. In the embodiment shown, the filters are generally rectangular in shape and are arranged within the filter door 94 and prefilter door 96 which are arranged on a back surface of the hood 66. The grossing station 20 may also include a cutting board insert 98 arranged within one of the removable interchangeable plates or grid plates 52 of the table 40 of the grossing station 20. The cutting board insert 98 may be made of any known plastic, ceramic, metal, or natural material that may allow for the cutting of specimens during the autopsy or necropsy procedure. The cutting board insert 98 may be arranged in any of the interchangeable plates 52 and may also be arranged next to a formaldehyde or formalin collection orifice 100. The grossing station 20 may also include a disposer 102 arranged and secured to an underneath surface of the table 40. The disposer 102 may be any known type of disposer, such as a garbage disposer, used in residential or commercial applications. However, any other type of disposer 102 including a specific medical disposer may also be used. The disposer 102 may be directly connected to outer sewer systems of the building in which the grossing station 20 is arranged or may be a self centered removable disposer that is removed and disposed of properly when medical waste is involved. It should be noted that the disposer 102 may be arranged on any of the under surfaces of the table 40 of the grossing station 20 depending on the set up of the specific grossing station 20. It should also be noted that the grossing station 20 may include a formalin dispensing fixture 104 generally arranged on a surface of the hood 66 or the table 40 of the grossing station 20. The formalin dispensing fixture 104 generally is arranged near the back draft grill or grate 70 into which the fumes are evacuated.

In operation, it should be noted that all of the necessary piping, plumbing, and electrical connections are secured either to a surface of the hood 66 of the grossing station 20, the table 40 or base 22 of the grossing station 20 and are connected to the building systems in which the grossing station 20 is arranged. Copper tubing, rubber tubing, any necessary electronic circuitry, switches, and any known pumps may be used to move the table 40 with relation to the base 22 and to move the air via the blower and ventilation system into either the outside atmosphere, a storage area or into a filter mechanism. Any known fasteners and holders, such as clips, rods, bands, etc., may be used to secure the piping and electrical components to the surfaces of either the table 40, base 22 or hood 66 of the grossing station 20 according to the present invention. The grossing station 20 integrated system for delivering chemicals and other components, such as gas or liquids to the table 40, may have the necessary piping, tubing, in either a closed or open loop system to operate with such chemicals in a closed environment of a building or lab. The necessary faucets and dispensers will all be arranged either on the table 40 or a surface of the hood 66 in order to provide an ergonomic work station such that dispensing of chemicals or other liquids or materials necessary for the pathology procedure are in easy reach of the lab or person conducting such procedures. In operation, the user may be able to adjust the height of the table top work surface of the grossing station 20 to fit his or her height. Thus, any user of the grossing station 20, either tall or short, can adjust the work surface for more ergonomic satisfaction with relation to their height. Furthermore, the operation of the lifting mechanism 38 may be controlled by a single touch switch in an upward or downward motion with relation to the floor in which the grossing station 20 is arranged. Furthermore, the operation of the blower system may allow for complete evacuation of all odors or noxious fumes from the work surface of the area which would keep fumes from emanating in an upward direction toward the user. This may ensure a more clean, efficient, and safe work environment for the user of the grossing station 20 versus those of the prior art. Furthermore, the interchangeability of the grid plates 52 and the waste compartment member 72 to be left handed or right handed, will provide a grossing station 20 that is more ergonomical and easy to use for the user performing the pathology procedures thereon.

The present description is for illustrative purposes only and it should not be construed to limit the present invention in any way. Thus, a person skilled in the art will appreciate that various modifications might be made to the present and disclosed embodiments without departing from the scope and spirit of the present invention, which is defined in terms of the claims below. Other aspects, features, and advantages may be apparent upon an examination of the attached drawing figures and appended claims.

What is claimed is:

1. A grossing station, said station comprising:

a table;

a rear grid grate arranged at a rear edge of said table;

an overhead hood connected to said table;

a blower and ventilation system arranged at a front and a rear of said table to move air across a top surface of said table from a front to rear direction, said blower and ventilation system having a ventilation duct secured over a front edge of said table, said blower and ventilation system having a plurality of blowers arranged near a front edge of said table, said ventilation duct having a C-shape when viewed in cross section, said ventilation duct having a channel connected to said C-shaped portion, said channel arranged on a bottom surface of said table;

a trough arranged in an upper surface of said table, said trough angled from a forward to a rearward direction with relation to said table when viewed from a side; and another channel arranged at a rear edge of said trough.

2. The station of claim 1 further comprising a sink arranged in said trough, said sink having a bottom that is above said trough angled surface.

3. The station of claim 1 further comprising at least one removable and interchangeable grid plate arranged at any position in said trough.

4. The station of claim 3 wherein said grid plate is a solid plate or a perforated plate.

5. The station of claim 3 wherein said grid plate having a rounded front edge.

6. The station of claim 1 further comprising a sliding panel arranged on each side of said table.

7. The station of claim 6 wherein said sliding panel slides with relation to said table, said sliding panel is made of glass.

8. The station of claim 1 further comprising a base, said table is arranged over and moves with relation to said base, said table having a faucet connected to one of or both sides of a top surface of said table.

9. The station of claim 8 further comprising a slidable shelf arranged in said base.

10. The station of claim 9 wherein said base having a door therein, said door allows for access to said slidable shelf.

11. The station of claim 10 wherein said door is partially hidden by said table when said table is in a lowest position with respect to said base.

12. The station of claim 9 wherein said sliding shelf having a full back wall and a lip formed at a front edge thereof.

13. The station of claim 1 further comprising a waste compartment secured to said table.

14. The station of claim 1 further comprising ventilation duct secured to a front edge of said table.

15. The station of claim 1 wherein said blower and ventilation system having another blower arranged at a rear edge of said table or on said hood, said air moves along said top surface of said table from said ventilation duct into said rear grid grate without emanating in an upward direction toward a user.

16. The station of claim 1 wherein said trough having a rectangular shape when viewed from above, said trough receives and holds at least three grid plates or sinks in any combination or configuration, said trough arranged a predetermined distance from a front edge of said table.

17. The station of claim 16 wherein said trough is connected to a drain.

18. The station of claim 1 wherein said blower and ventilation system creates constant air flow and removes all odors and fumes from all portions of said top surface of said table including a sink.

* * * * *